US006461123B1

(12) United States Patent
Lotz

(10) Patent No.: US 6,461,123 B1
(45) Date of Patent: Oct. 8, 2002

(54) TURBOMOLECULAR PUMP

(75) Inventor: Heinrich Lotz, Wetzlar (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/694,923

(22) Filed: Oct. 24, 2000

(30) Foreign Application Priority Data

Oct. 28, 1999 (DE) ..... 199 51 954

(51) Int. Cl.[7] ..... F04B 17/00; F04B 35/04
(52) U.S. Cl. ..... 417/423.4
(58) Field of Search ..... 417/423.4, 42.1, 417/48, 49, 410.1

(56) References Cited

U.S. PATENT DOCUMENTS 3,168,978 A 2/1965 Garnier et al.
4,174,074 A * 11/1979 Geiger ..... 241/172
4,562,368 A * 12/1985 Weldon et al. ..... 310/178
4,732,529 A * 3/1988 Narita et al. ..... 415/90
5,358,373 A 10/1994 Hablanian
5,722,819 A * 3/1998 Broisin et al. ..... 415/90
5,971,725 A * 10/1999 de Simon et al. ..... 417/423.1
6,030,189 A * 2/2000 Bohm et al. ..... 415/90
6,071,092 A * 6/2000 Casaro et al. ..... 310/90
6,106,223 A * 8/2000 Leyshon ..... 415/116
6,109,887 A * 8/2000 Takura et al. ..... 417/348
6,186,749 B1 * 2/2001 Bouille et al. ..... 417/295
6,220,831 B1 * 4/2001 Shiokawa et al. ..... 417/295
6,290,457 B1 * 9/2001 Kabasawa et al. ..... 415/222

OTHER PUBLICATIONS

SP–03 017 357 Patent Abstract of Japan, vol. 015, No. 134, Apr. 3, 1001.

* cited by examiner

*Primary Examiner*—Teresa Walberg
*Assistant Examiner*—Daniel Robinson
(74) *Attorney, Agent, or Firm*—Sidley Austin Brown & Wood, LLP

(57) ABSTRACT

A turbomolecular pump including a plurality of separate one-piece stator elements, with each stator element including a respective housing part of a cylindrical housing of the pump, a stator disc, and a spacer disc that determines spacing between adjacent stator discs, and a plurality of rotor discs arranged in the pump housing and alternating with the stator disc.

4 Claims, 1 Drawing Sheet

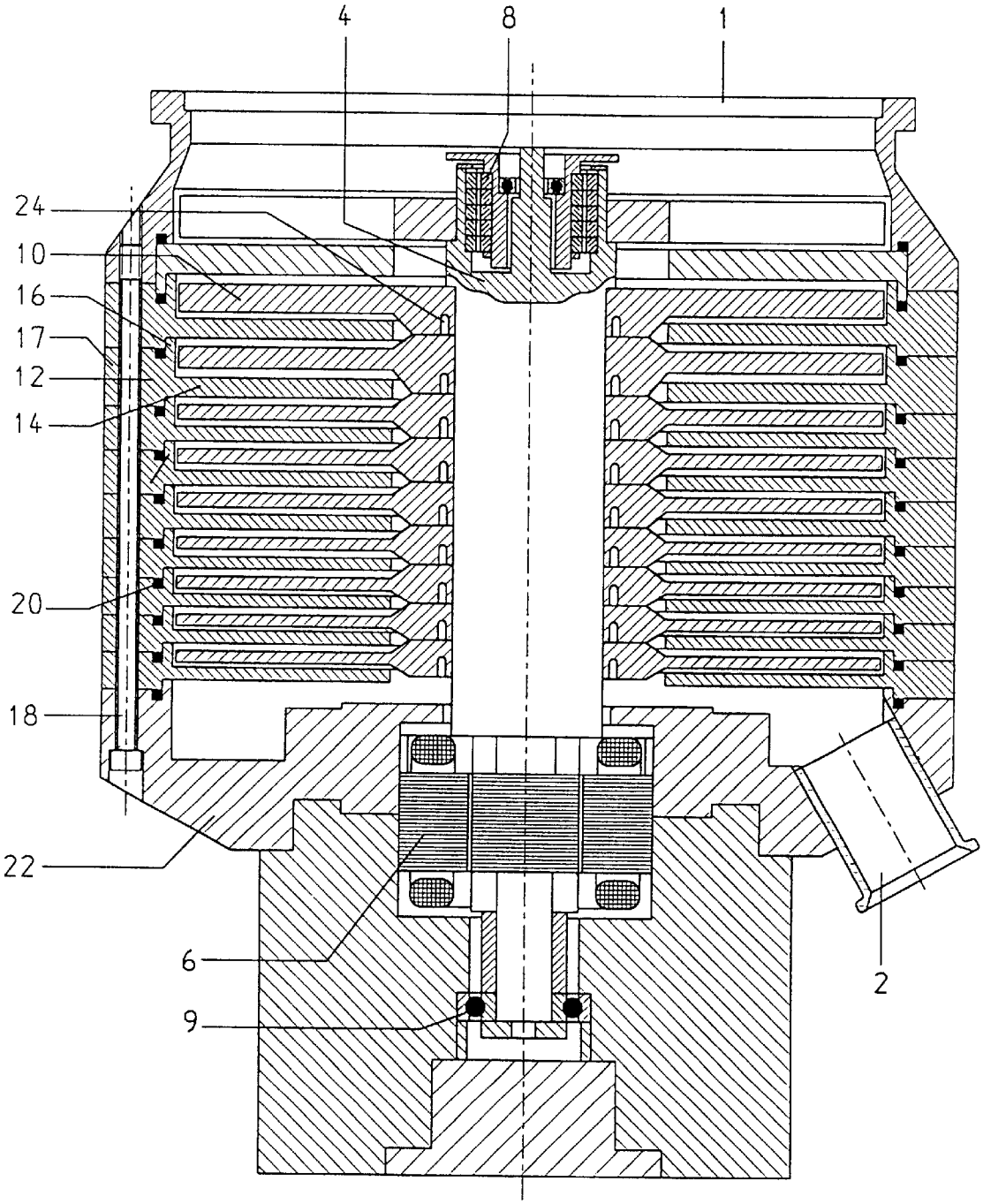
4
8
1
24
10
16
17
12
14
20
18
22
6
9
2

TURBOMOLECULAR PUMP

BACKGROUND OF THE INVENTION

1. Field of the Invention

The present invention relates to a turbomolecular pump including a housing and stator and rotor disc arranged in the housing.

2. Description of the Prior Act

Active pumping elements of a turbomolecular pump consist of rotor and stator discs provided with vanes and arranged alternatively one behind the other. The rotor and stator discs have each an inner carrier ring on an outer side of which a vane is provided. The vanes of the rotor discs, which rotate with a high speed, produce, together with the stator vanes, a pumping effect. Spacer rings are arranged between the rotor discs at their outer circumference, separating the rotor discs from each other by a distance that insures a contact-free rotation of the rotor discs. Stator discs, together with spacer rings, form a stator which is centered by the housing inner wall, with the stator discs and spacer rings being, e.g., pressed to each other axially with springs, whereby the stator discs and the spacer rings form a rigid connection. To facilitate assembly of the pump, the stator discs are formed each of two half-discs.

This conventional design of a turbomolecular pump has many drawbacks, the major one being the necessity to produce a large number of separate parts. This result in high manufacturing costs and increased assembly time and adversely affects repair and maintenance works. The need to maintain narrow tolerances, which are necessary for the reliable operation of the turbomolecular pump, together with a large number of parts, results in extremely high expenses. Further, radial centering and axial fixation of the stator discs require additional adjustment which, likewise, contributes to increased manufacturing costs. The formation of stator discs of two half-discs leads to a certain uncertainty with respect to the tolerances and results in additional leakage within the pump.

Accordingly, an object of the present invention is to provide a turbomolecular pump a number of components of which is substantially reduced in comparison with conventional turbomolecular pumps.

Another object of the present invention is to produce a turbomolecular pump that can be produced with substantially reduced manufacturing costs in a shorter time and maintenance of which is substantially simplified.

A further object of the present invention is to produce a turbomolecular pump in which leakage inside the pump caused by formation of the stator discs of two half-discs is prevented.

A still further object of the present invention is to produce a turbomolecular pump with improved removal of heat generated during the pump operation outside of the pump in order to improve the pump operational characteristics.

SUMMARY OF THE INVENTION

These and other objects of the present invention, which will become apparent hereinafter, are achieved by providing a plurality of separate, one-piece stator elements each of which has a respective housing part of the pump cylindrical housing, a stator disc, and a spacer disc.

The present invention permits to substantially reduce the number of components of a turbomolecular pump. This simplifies manufacturing and reduces assembly time. Also, the maintenance works are simplified and reduced. Obtaining of necessary tolerances is substantially facilitated in view of a smaller number of pump components. The radial centering and axial fixing of the stotor disc is obtained automatically during manufacturing and no further adjustment is required.

The removal of heat, which is generated during the pump operation, is substantially improved due to the compact design of the housing and to the elimination of transitional regions which in conventional pumps hinder arrangement of the heat conductors for heat removal. In addition, provision of cooling or heating elements in the region of stator elements permits to provide for an operational temperature regulation of the entire construction, in particular, of pump active parts in dependence on the operational condition of the pump.

When the rotor discs are secured on the rotor shaft separately one after the other with separate locking elements and not, as previously, are mounted on the shaft as a package of rotor discs by heat shrinking or are produced as a block, then the stator components can be mounted as integral parts and need not be preliminary be separated in the middle. Thereby, additional leakage within the pump is eliminated, and the disturbing backflows are avoided.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows an axial cross-sectional view of a turbomolecular pump according to the present invention.

DETAILED DESCRIPTION OF THE PREFERRED EMBODIMENT

A turbomolecular pump according to the present invention, which is shown in the drawings, includes a suction opening 1 and a gas outlet opening 2. The inventive pump further includes a rotor shaft 4 which is driven by a motor 6 and is supported in opposite bearings 8 and 9. A plurality of rotor discs 10 is supported on the rotor shaft 4 and are secured thereon with respective locking elements 24.

The pump further includes a plurality of one-piece stator elements 12 each including a respective housing part 17 of the pump. cylindrical housing, a stator disc 14, and a spacer ring 16 which determines spacing between adjacent stator discs 14. Sealing elements 20 are provided between separate stator elements 12 which are stacked one upon the other. The stator elements 12 are held together with screw members 18 and are secured therewith to the pump bottom 22.

Though the present invention was shown and described with references to the preferred embodiment, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments with the spirit and scope of the present invention as defined by the appended claims.

What is claimed is:

1. A turbomolecular pump, comprising a plurality of separate one-piece stator elements, with each stator element including a respective housing part of a cylindrical housing of the pump, a stator disc, and a spacer ring that determines spacing between adjacent stator discs; and a plurality of rotor discs arranged in the pump housing and alternating with the stator discs, the rotor discs cooperating with the stator discs to produce a pumping effect.

2. A turbomolecular pump as set forth in claim 1, further comprising a plurality of sealing elements arranged between the separate stator elements, respectively.

3. A turbomolecular pump as set forth in claim 1, further comprising screw means for securing the separate stator elements with each other.

4. A turbomolecular pump as set forth in claim 1, further comprising a rotor shaft arranged in the pump housing, and clamping means for securing the rotor discs on the rotor shaft.

* * * * *